US005538215A

United States Patent [19]

Hosey

[11] Patent Number: 5,538,215

[45] Date of Patent: Jul. 23, 1996

[54] SIDERAIL SOCKET

[75] Inventor: David P. Hosey, St. Mary's, Ohio

[73] Assignee: Midmark Corporation, Versailles, Ohio

[21] Appl. No.: 339,963

[22] Filed: Nov. 15, 1994

[51] Int. Cl.[6] ..... E04G 3/00

[52] U.S. Cl. ..... 248/286.1; 248/218.4; 248/229.11

[58] Field of Search ..... 248/286.1, 218.4, 248/316.1, 541, 292.12, 296.1, 540, 125.1, 125.2, 125.3, 229.11, 228.2; 403/384, 385, 388, 394, 97, 59, 389

[56] References Cited

U.S. PATENT DOCUMENTS

| | | | |
|---|---|---|---|
| 2,456,505 | 12/1948 | Hastings | 248/124 |
| 2,622,831 | 12/1952 | Fullwood | 248/316.1 |
| 2,651,725 | 9/1953 | McFarland | 250/58 |
| 2,940,783 | 6/1960 | Engelhardt | 287/56 |
| 3,157,378 | 11/1964 | Blum | 248/218.4 |
| 4,018,412 | 4/1977 | Kees | 248/286.1 |
| 4,355,631 | 10/1982 | LeVahn | 128/20 |
| 4,547,092 | 10/1985 | Vetter et al. | 403/59 |
| 4,796,846 | 1/1989 | Meier et al. | 248/286 |
| 4,865,484 | 9/1989 | McConnell | 403/59 |
| 5,108,213 | 4/1992 | Shields | 403/18 |
| 5,219,349 | 6/1993 | Krag et al. | 606/53 |

*Primary Examiner*—Karen J. Chotkowski
*Assistant Examiner*—Gwendolyn Wrenn-Baxter
*Attorney, Agent, or Firm*—Biebel & French

[57] ABSTRACT

A siderail socket or clamp for mounting a support rod of a surgical accessory on the siderail of a medical table comprises a frame defining first and second channels for receiving the siderail and the support rod, respectively; a first actuator for actuating the support rod along a path of travel transverse to an extension of the second channel and a second actuator extending into the first channel. The second actuator is moveable transversely to the path of travel in response to actuation of the support rod along the path of travel for actuating the siderail transversely to an extension of the first channel. The movement of the second actuator transversely to the path of travel of the support rod in the second channel permits the siderail socket to grip the siderail across two perpendicular dimensions, thereby reducing the "play" of the socket relative to the siderail.

15 Claims, 6 Drawing Sheets

SIDERAIL SOCKET

BACKGROUND OF THE INVENTION

1. Field of the Invention

This invention relates to the field of surgery, and more particularly relates to a siderail socket for mounting a support rod of a surgical accessory on the siderail of a medical or operating table.

2. Description of the Related Art

Surgical accessories such as leg holders and arm supports are often mounted on support rods to position the accessories and support a patient lying on a medical or operating table. Commonly, such support rods are secured to siderails which extend parallel to the sides of the medical table. The support rods are typically clamped near one end to the siderail and include elbows defining portions which extend over the upper surface of the table to position the accessories. Preferably, the angular orientation of the support rods relative to the side of the table is adjustable to provide increased control over the placement of the accessories.

Medical table siderails are typically rectangular in cross-section, with their shortest dimension parallel to the upper surface of the table. One known form of siderail socket or clamp grips opposite sides of a siderail between flat surfaces of the clamp. A drawback to such clamps is that a degree of "play" may exist between the clamp and the siderail. That is, since the siderail is gripped between flat surfaces, the clamp may be slightly displaced laterally or angularly if bumped or jarred. This displacement of the clamp may affect the placement of a surgical accessory mounted on a support rod secured to the siderail by the clamp.

In certain procedures, it is particularly desirable to minimize movement of accessories clamped to the siderails. For example, during certain neurosurgery procedures, a clamping structure held in place on the siderails is used to immovably locate a patient's head.

One proposed form of clamp which attempts to reduce the amount of movement of the clamp includes a pivoting jaw configured such that the clamp engages against all four sides of the cross-section of the siderail to grip the siderail across two perpendicular dimensions. While the engagement of this clamp with the siderail across two perpendicular dimensions may reduce the "play" between the siderail and the clamp, the pivoting jaw increases the complexity of the clamp as well as its effective size.

SUMMARY OF THE INVENTION

The above-noted drawbacks and others are addressed by a siderail socket or clamp of the present invention which is provided for mounting a support rod of a surgical accessory on the siderail of a medical table. The socket comprises a frame defining first and second channels for receiving the siderail and the support rod, respectively; a first actuator for actuating the support rod along a path of travel transverse to an extension of the second channel; and a second actuator extending into the first channel. The second actuator is moveable in response to actuation of the support rod along its path of travel whereby the socket is biased into engagement with the siderail transversely to an extension of the first channel. The movement of the second actuator permits the siderail socket to grip the siderail across two perpendicular dimensions, thereby reducing the "play" of the socket relative to the siderail.

In a preferred form, the frame includes a rail bracket and a clamp tube. The rail bracket includes a plate and spaced walls. At least one of the spaced walls includes a tab spaced from the plate and extending transversely from that wall to define the first channel. The clamp tube defines the second channel and is rotatably receivable in a first hole in the rail bracket for sliding movement along a path of travel transverse to an extension of the first channel. Since the clamp tube is rotatable relative to the rail bracket, the relative orientation between the first and second channels may be adjusted to adjust the angular orientation of the support rod relative to the side of the medical table.

Furthermore, the first actuator is a clamp handle which includes a threaded press for extension through a threaded passage in the clamp tube into the second channel. A crossbar is provided coupled to the threaded press for manually actuating the threaded press into engagement with the support rod.

In addition, the second actuator includes a rail clamp bracket defining a second hole aligned with the first hole in the rail bracket for receiving the clamp tube. The rail clamp bracket has at least one detent extending through openings in the rail bracket into the first channel. The detent includes a wedge portion adapted to press against the siderail transversely to the path of travel and a block portion adapted to press against the siderail generally parallel with the path of travel. The wedge portion and the rail bracket define facing surfaces oblique to the path of travel. The facing surfaces slide relative to each other for actuating the detent in a direction oblique to the path of travel so that the detent presses against the siderail to clamp the siderail across its two perpendicular faces.

Finally, the socket includes a tube holder defining a sleeve for slidably receiving the clamp tube and including opposed tapered slots alignable with the second channel for receiving the support rod. The clamp tube is keyed to the tube holder to inhibit rotation of the tube holder relative to the clamp tube so that the slots remain aligned with the second channel.

The tube holder and the rail clamp also include meshing teeth for selecting a relative orientation of the support rod relative to the siderail. A wave spring is positioned between a shoulder on the clamp tube and an opposing surface on the tube holder to facilitate disengagement of the meshed teeth.

Accordingly, it is one object of the present invention to provide a siderail socket or clamp which reduces the "play" between the clamp and the siderail. This and other objects, features and advantages of the present invention will be described in further detail in connection with preferred embodiments of the invention shown in the accompanying drawings.

DETAILED DESCRIPTION OF THE PREFERRED EMBODIMENT

Figure 1:
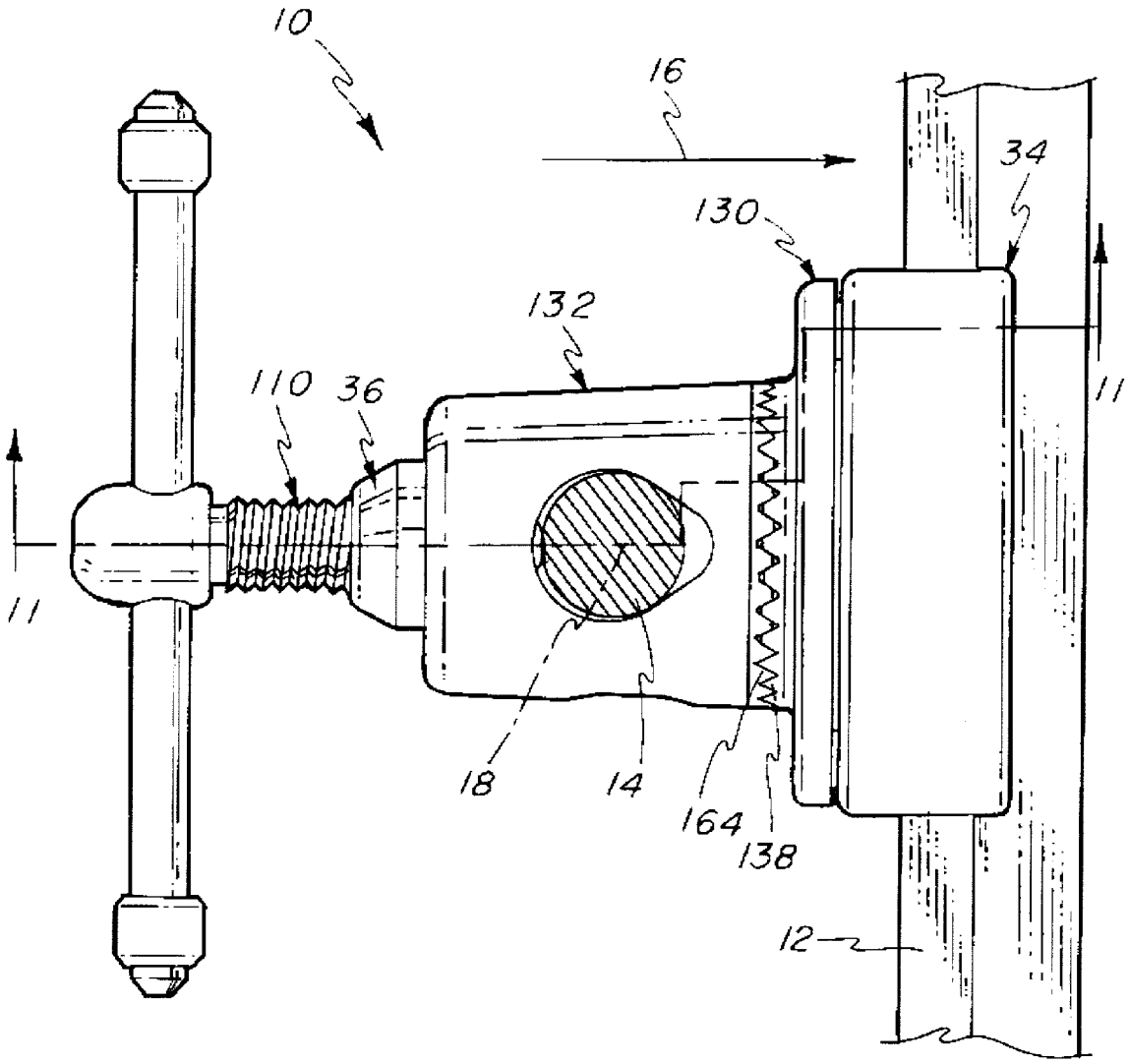
FIG. 1 is top plan view of a siderail socket or clamp according to the present invention.

FIG. 1 shows a siderail socket 10 which comprises apparatus for restraining a first bar 12 and a second bar 14 in a selected relative orientation. In a preferred application, the first bar 12 is the siderail of a medical or operating table and the second bar 14 is a support rod for a surgical accessory (not shown) such as a leg holder or arm support. In this preferred application, the siderail socket 10 is clamped to the first bar 12, that is, the siderail, such that the direction indicated by the arrow 16 in FIG. 1 is normal to, and faces toward, a vertical side of the medical table (not shown). The siderail socket 10 clamps the second bar 14, that is, the support rod, such that an axis 18 of the second bar 14 is substantially vertical relative to a horizontal patient-receiving surface of the table (not shown). In a preferred form, the second bar 14 includes a bend or elbow (not shown) spaced from the apparatus 10 so that an end portion (not shown) of the second bar 14 extends toward the patient to support a surgical accessory (not shown). In FIG. 1, the first bar 12 and the second bar 14 are shown oriented approximately 90° relative to each other.

Figure 2:
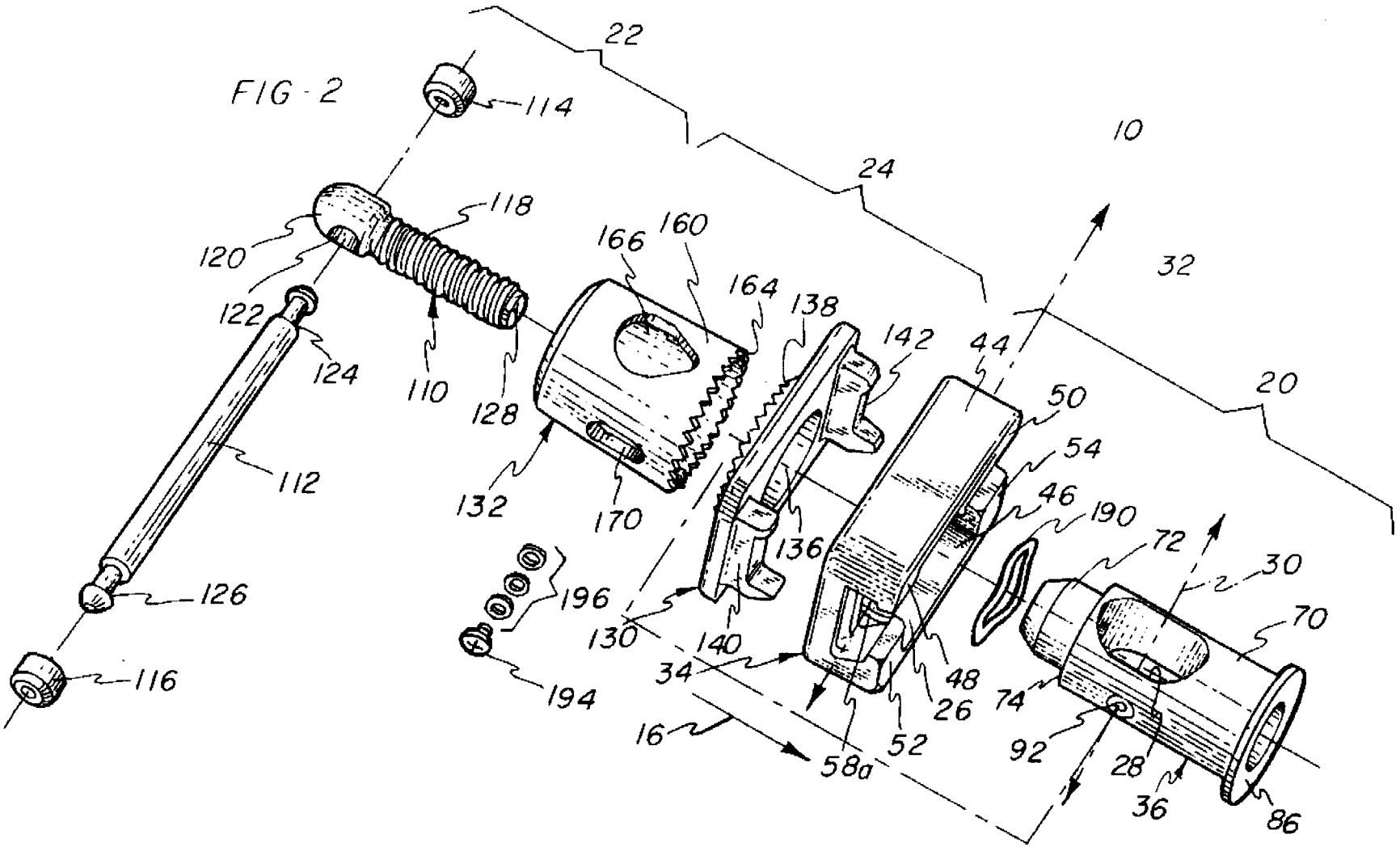
FIG. 2 is an exploded perspective view of the siderail socket of FIG. 1.

Referring to FIG. 2, the siderail socket 10 comprises a frame 20, a first actuator or clamp handle 22 and a second actuator 24. The frame 20 defines a first channel 26 for receiving the first bar 12 and a second channel 28 for receiving the second bar 14. The first actuator 22 is provided to actuate the second bar 14 along a path of travel parallel to the arrow 16, which is transverse to an extension 32 of the first channel 26. Similarly, the second actuator 24 is provided to actuate the second bar 14 transversely to the extension 32 of the first channel 26.

Figure 3:
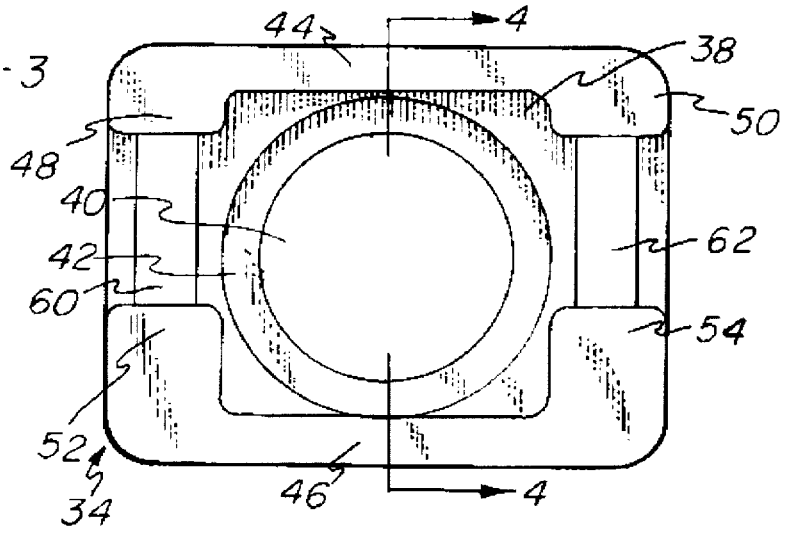
FIG. 3 is a plan view of a rail bracket for the siderail socket of FIG. 1.
Figure 4:
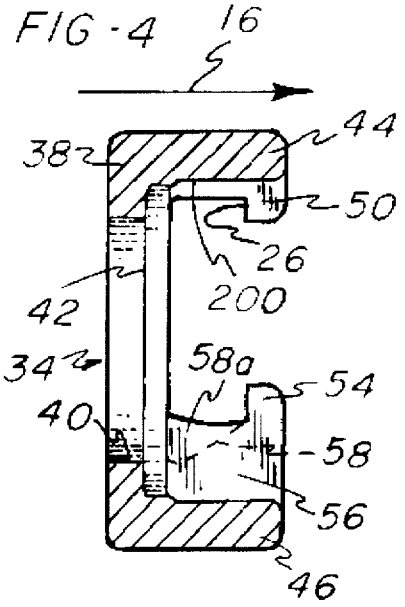
FIG. 4 is a sectional view of the rail bracket of FIG. 3 taken along the line 4—4 in FIG. 3.

The frame 20 includes a rail bracket 34 defining the first channel 26 and a clamp body or clamp tube 36 defining a second channel 28 having an extension indicated by 30. As shown in FIGS. 3 and 4, the rail bracket 34 is preferably a unitary metal piece including a rail bracket plate portion 38 defining a circular hole 40 surrounded by an annular groove 42; opposite wall portions 44 and 46; and tabs 48, 50, 52 and 54 which cooperate to define the first channel 26. The tabs 52 and 54 each include web portions 56 (only one shown in FIG. 4) defining first surfaces 58 (only one shown in FIG. 4). When the siderail socket 10 is assembled, the first surfaces 58 are oblique to the path of travel, that is, oblique to the direction of the arrow 16 (FIG. 4). In addition, the plate portion 38 includes rectangular slots 60, 62 aligned with the oblique surfaces 58.

As best shown in FIGS. 2 and 4, the rail bracket 34 includes a pair of ribs **58*a* projecting from the oblique surfaces 58 adjacent the slots 62. When the siderail socket 10 approaches the end of the siderail 12, these ribs 58*a* engage knobs 58*b* (FIG. 4A) on the outer surfaces of the siderail 12 to prevent the siderail socket 10 from sliding off the siderail 12**.

Figure 4A:
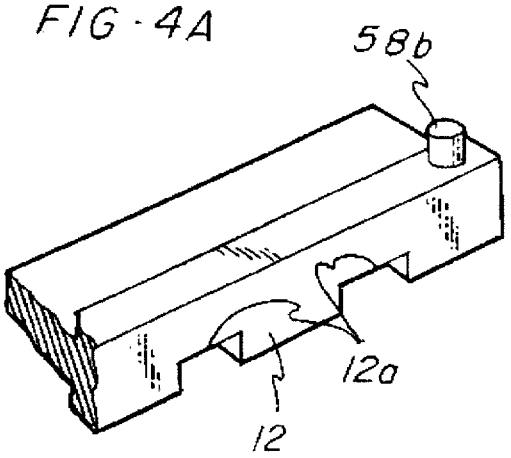
FIG. 4A is a partial perspective view of a siderail for a medical or operating table.

As best shown in FIG. 4A, the siderail 12 is preferably "T"-shaped in cross-section includes a pair of slots **12*a* near one end thereof. The slots 12*a* are positioned and sized to receive the tabs 48, 50 so that the rail bracket 34 may be installed on the siderail 12**.

Figure 5:
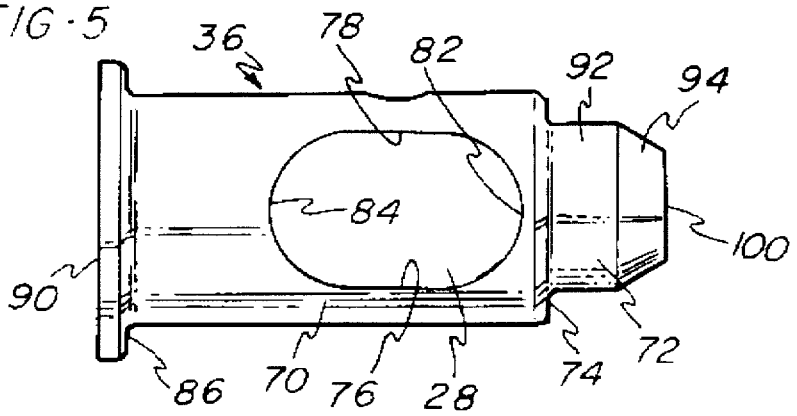
FIG. 5 is a side elevational view of a clamp body or clamp tube for the siderail socket of FIG. 1.
Figure 6:
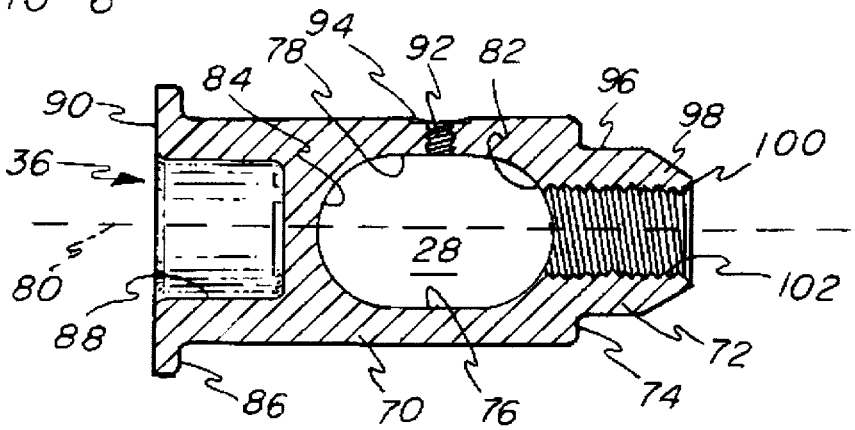
FIG. 6 is a central sectional view of the clamp body or clamp tube of FIG. 5.

Referring to FIGS. 5 and 6, the clamp body or clamp tube 36 is preferably a unitary metal piece including a cylindrical body 70 and a neck 72 separated by a shoulder 74 wherein the cylindrical body 70 defines the second channel 28. The second channel 28 comprises a straight tunnel through the cylindrical body 70 having straight sides 76, 78 parallel to a longitudinal axis 80 of the clamp tube 36 and semi-circular sides 82, 84 normal to the axis 80. A threaded hole 92 extends radially inwardly to the second channel 28 from a countersink area 94 on the side of the cylindrical body 70. The cylindrical body 70 also includes a flange 86 surrounding a blind hole 88 through a first axial end 90 of the clamp tube 36, and the cylindrical neck 72 includes a cylindrical portion 96 and a frusto-conical section 98 terminating in a second axial end 100 of the clamp tube 36. A threaded hole 102 extends through the neck 72 to the second channel 28, parallel to the axis 80.

As shown in FIG. 2, the first actuator or clamp handle 22 is formed with a press 110, a crossbar 112 and a pair of resilient polymeric grommets 114, 116. The press 110 includes a threaded length 118 for engagement in the threaded hole 102 (FIG. 6) of the clamp tube 36 and includes a head 120 defining an eye 122 for receiving the crossbar 112. The crossbar 112 includes grooves 124, 126 near each axial end for positioning the grommets 114, 116 to retain the crossbar 112 in the eye 122. The threaded length 118 of the press 110 defines a pressure surface 128 at one end normal to the path of travel, that is, normal to the direction of the arrow 16, for applying pressure against the second bar 14 located in the second channel 28.

Figure 7:
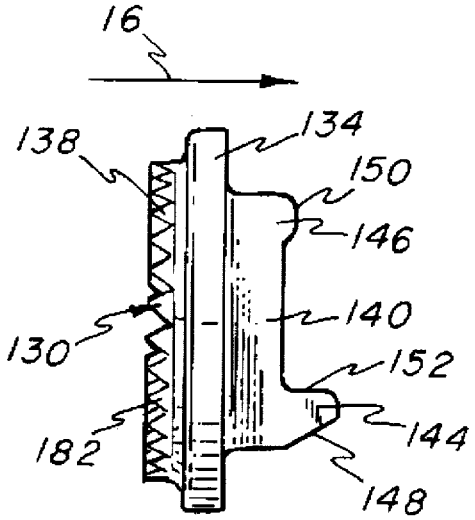
FIG. 7 is a side elevational view of a rail clamp bracket for the siderail socket of FIG. 1.
Figure 8:
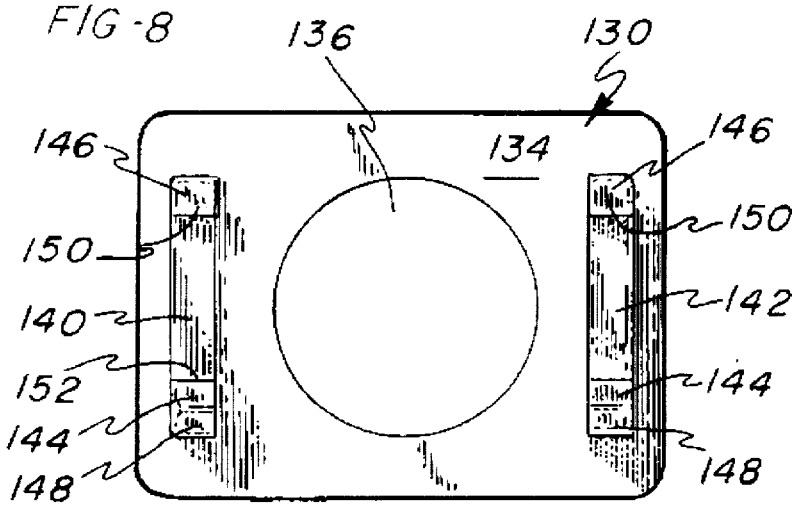
FIG. 8 is plane view of the rail clamp bracket of FIG. 7.

The second actuator 24 includes a rail clamp bracket 130 and a clamp body holder or tube holder 132. As best seen in FIGS. 7 and 8, the rail clamp bracket 130 is preferably a unitary metal piece including a plate portion 134 defining a circular hole 136 (FIG. 8), a toothed boss 138 (FIG. 7) projecting from one side of the plate portion 134 surrounding the hole 136 (FIG. 8), and a pair of detents 140, 142 projecting from an opposite side of the plate portion 134. The detents 140, 142 include a wedge portion 144 and a block portion 146. Each of the wedge portions 144 define a second surface 148 which, when the siderail socket 10 is assembled, is substantially parallel to a facing one of the first surfaces 58 (FIG. 4) and is oblique to the path of travel indicated by the arrow 16 (FIG. 7). The block portion 146 defines a pressure surface 150 normal to the path of travel 16, while the wedge portion 144 defines a pressure surface 152 parallel to the path of travel 16.

Figure 9:
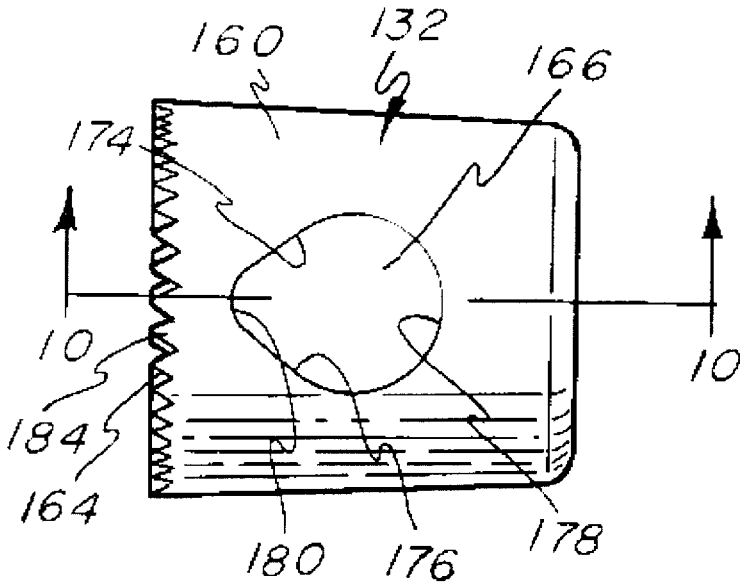
FIG. 9 is an elevational view of a clamp body holder or tube holder for the siderail socket of FIG. 1.
Figure 10:
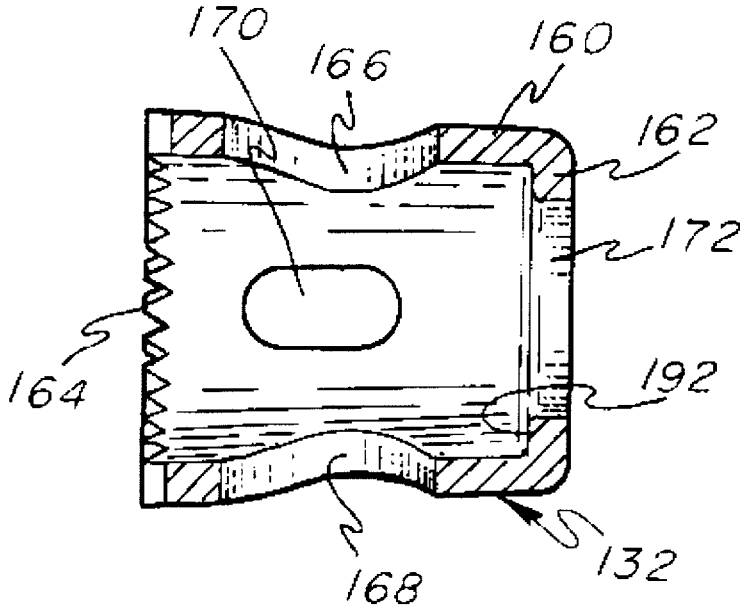
FIG. 10 is a sectional view of the clamp body holder or tube holder taken along the line 8—8 in FIG. 7.

As best seen in FIGS. 9 and 10, the clamp body holder or tube holder 132 of the second actuator 24 is a unitary metal piece including a mildly tapering sleeve 160 terminating in a counterflange 162. The sleeve 160 defines a toothed axial end portion 164 axially opposite the counterflange 162. The sleeve 160 also defines a pair of diametrically aligned tapered slots 166, 168 and an elongated keyway slot 170 facing perpendicularly to the tapered slots 166, 168. The counterflange 162 defines a circular opening 172 sized to rotatably receive the neck 72 of the clamp tube 36.

As best seen in FIG. 9, the tapered slots 166, 168 are each defined by a pair of tapering linear sides 174, 176 extending tangentially between circular arcs 178, 180. The slots 166, 168 are each configured such that the radius of curvature of the arc 180 nearer the toothed axial end portion 164 is smaller than the radius of curvature of the arc 178 farther from the end 164. This permits the siderail socket 10 to clamp round bars, such as the first bar 12 (FIG. 1), of various diameters greater than the diameter of the arc 180 and less than the diameter of the arc 178.

Referring to FIGS. 1, 7 and 9, the toothed boss 138 of the rail clamp bracket 130 and the toothed axial end portion 164 of the tube holder 132 include a plurality of annularly-arrayed triangular teeth 182 and 184, respectively, such that the toothed boss 138 meshes with the toothed axial end portion 164 when the second actuator 24 is assembled. The meshing of the boss 138 and the axial end portion 164 enables the tube holder 132 to rotate and be located in selected positions relative to the rail clamp bracket 130 when the siderail socket 10 is loosened whereby a particular orientation of the second bar 14 relative to the first bar 12 may be selected. Though the angle of the teeth is not critical, it is preferred that the slopes of the teeth 182, 184 be sufficiently steep to restrain the tube holder 132 from rotating relative to the rail clamp bracket 130 when the siderail socket 10 is tightened.

Referring to FIG. 2, the frame 20 is assembled by sliding the clamp tube 36 into the rail bracket 34 such that the cylindrical body 70 (FIGS. 5 and 6) of the clamp tube 36 is rotatably received through the circular hole 40 (FIGS. 3 and 4) in the rail bracket 34. Preferably, the flange 86 of the clamp tube 36 engages the annular groove 42 (FIGS. 3 and 4) of the rail bracket 34 to rotatably align the clamp tube 36 in the circular hole 40 with the flange 86 recessed into the bracket plate portion 38. The rail clamp bracket 130 is next placed over the clamp tube 36, such that the circular hole 136 of the rail clamp bracket 130 receives the clamp tube 36 and the detents 140, 142 of the rail clamp bracket 130 project through the elongated slots 60, 62 (FIG. 3) of the rail bracket 34 into the first channel 26. The rail clamp bracket 130 is oriented with respect to the rail bracket 34 such that the first faces 58 engage the second faces 148 as the plate portion 134 of the rail clamp bracket 130 approaches the plate portion 38 (FIGS. 3 and 4) of the rail bracket 34.

The tube holder 132 is positioned over the clamp tube 36 such that the cylindrical portion 70 of the clamp tube 36 is rotatably received in the sleeve 160 of the tube holder 132 while the neck 72 of the clamp tube 36 projects through the circular opening 172 defined by the counterflange (FIG. 10) of the tube holder 132. Preferably, a circular wave spring 190 is positioned between the shoulder 74 of the clamp tube 36 and a facing abutting surface 192 (FIG. 10) defined by the counterflange 162 (FIG. 10) of the tube holder 132. The wave spring biases the tube holder 132 away from the rail clamp bracket 132 to facilitate disengagement of the toothed axial end portion 164 of the tube holder 132 from the toothed boss 138 of the rail clamp bracket 130.

When positioning the tube holder 132 on the clamp tube 36, the tapered slots 166, 168 of the tube holder 132 are aligned with the second channel 28 defined through the clamp tube 36, while the radially-extending threaded hole 92 (FIG. 6) in the clamp tube 36 is aligned with the keyway slot 170 (FIG. 10) through the tube holder 132.

A bolt 194 and one or more spacers 196 are passed through the keyway slot 170 and threaded into the radially-extending threaded hole 92 to serve as a key to inhibit rotation of the tube holder 132 relative to the clamp tube 36. The elongation of the keyway slot 170 permits the tube holder 132 to slide relative to the clamp tube 36 to permit disengagement of the toothed axial end portion 164 of the tube holder 132 from the toothed boss 138 of the rail clamp bracket 130 and coordinate rotation of the tube holder 132 and clamp tube 36 for changing the relative orientation of the extensions 30, 32 of the first and second channels 26, 28.

The first actuator 22 is coupled to the clamp tube 36 by threading the threaded portion 118 of the press 110 in the threaded hole 102 (FIG. 6) of the clamp tube 36. By turning the press 110 using the crossbar 112, the threaded portion 118 may be extended into the second channel 28 for engagement with the second bar 14.

Figure 11:
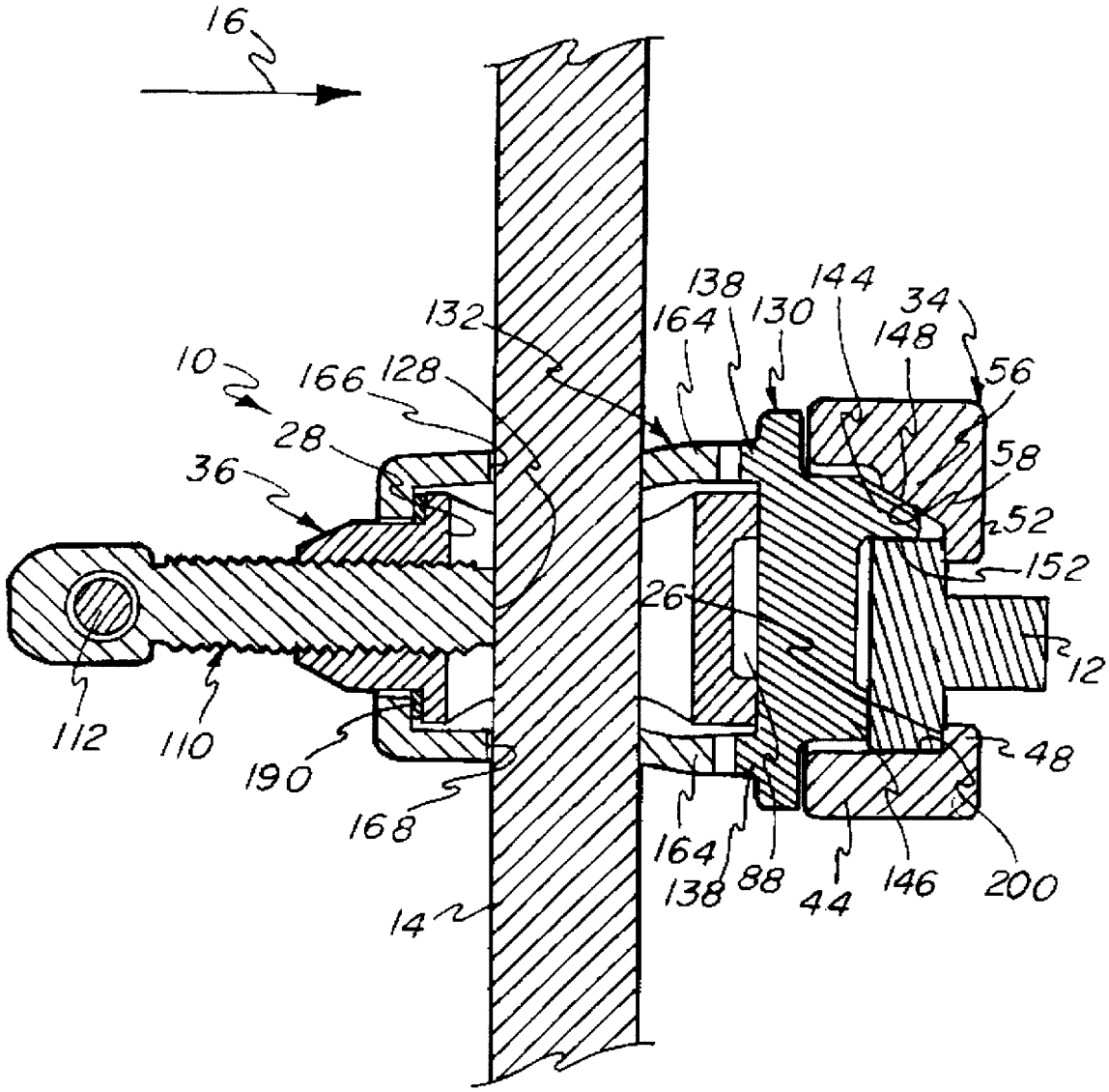
FIG. 11 is a sectional view of the siderail socket of FIG. 1 taken along the line 11—11 in FIG. 1.

A method for using the siderail socket 10 will now be described in connection with FIG. 11.

The siderail socket 10 is placed on the first bar 12 whereby the first bar 12 is positioned extending through the first channel 26. The second bar 14 is positioned extending through the second channel 28 and in engagement with the tapered slots 166, 168 defined in the tube holder 132. As the press 110 is rotated to cause the press 110 to move into the clamp tube 36, the pressure surface 128 of the press 110 will move into engagement with the second bar 14 forcing the second bar 14 into engagement with the portions of the slots 166, 168 adjacent to the circular arcs 180.

It should be noted that as the press 110 is rotated into the clamp tube 36, it draws the clamp tube 36 in a direction opposite to the path of travel indicated by arrow 16 whereby the flange 86 of the clamp tube 36 firmly engages with the annular groove 42 of the rail bracket 34. At the same time, the clamp tube holder 132 and clamp bracket 130 are biased in the direction of arrow 16 whereby the first bar 12 is gripped between the clamp bracket 130 and the rail bracket 34. Specifically, as the clamp bracket 130 is biased in toward the rail bracket 34, the block portions 146 of the clamp bracket 130 are forced into engagement with a side of the first bar 12 thereby exerting a biasing force on the first bar 12 in the direction of arrow 16 such that the first bar 12 is clamped between the block portions 146 and the tabs 48, 50 of the rail bracket 34.

The relative movement between the clamp bracket 130 and rail bracket 34 also causes the second surfaces 148 defined by the wedge portions 144 of the clamp bracket 130, to engage and slide along the first surfaces 58 defined by the web portions 56 of the rail bracket 34. Since the first and second surfaces 58, 148 are oblique to the path of travel, the wedge portions 144 are caused to move transversely (that is, normally or obliquely) to the path of travel indicated by the arrow 16. Consequently, the first bar 12 is clamped between the pressure surface 152 defined by the wedge portion 144 of the rail clamp bracket 130 and a pressure surface 200 defined by the wall portion 44 of the rail bracket 34 generally perpendicular to the path of travel. This clamping along generally perpendicular directions provides a firm engaging force between the siderail socket 10 and the first bar 12 to thereby minimize "play" in the clamping of the first bar 12.

The first and second bars 12, 14 may be unclamped by turning the crossbar 112 to move the pressure surface 128 of the press 110 away from the second bar 14. Release of the second bar 14 relieves the pressure on the tube holder 132 and the rail clamp bracket 130, which in turn releases the socket 10 from first bar 12.

Preferably, the relative orientation of the first and second bars 12, 14 is selected prior to tightening of the first actuator 22 against the second bar 14. The relative orientation may be selected by rotating the tube holder 132 relative to the rail clamp bracket 130 until the first and second channels 26, 28 are in the selected orientation and then meshing the toothed axial end portion 164 of the tube holder 132 with the toothed boss 138 of the rail clamp bracket 130 by rotating the press 110 into the clamp tube 36.

In the preferred application of the invention the first bar 12 is a siderail mounted to a side of a medical or operating table, while the second bar 14 is a support rod for supporting a surgical accessory. In this application, a method for clamping the siderail 12 and the support rod 14 includes aligning the rail bracket 34 with the slots 12*a* near an end of the siderail 12 and pushing the rail bracket 34 toward the table (not shown) onto the siderail 12. The siderail socket 10 may then be slid along the siderail 12 until the siderail socket 10 is located at a desired position.

The support rod 14 is inserted into the second channel 28 and the tube holder 132 is rotated relative to the rail clamp bracket 130 to select the relative angular orientation between the siderail 12 and the support rod 14. The first actuator 22 is then tightened by manually grasping and turning the crossbar 112 and press 110 to tighten the first actuator 22. As discussed previously, tightening the first actuator 22 clamps both the siderail 12 and the support rod 14 in their respective channels 26 and 28, and induces clamping of the siderail 12 along perpendicular directions to substantially rigidly locate the rod 14 at a desired position relative to the siderail 12.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. Apparatus for locating a pair of bars in a selected relative orientation, comprising:

a frame defining a first channel for receiving a first bar, said frame further defining a second channel for receiving a second bar;

a first actuator for actuating the second bar for movement transverse to an extension of said second channel, said movement transverse to an extension of said second channel defining a path of travel for said second bar;

a second actuator extending into said first channel, said second actuator being moveable transversely to said path of travel in response to actuation of said second bar along said path of travel for actuating the first bar transversely to said path of travel and;

wherein said second actuator includes a detent projecting into said first channel, and wherein one, of said detent and said frame defines a surface oblique to said path of travel for sliding engagement with the other of said detent and said frame.

2. The apparatus as recited in claim 1 wherein said frame includes a bracket defining said first channel and a clamp body defining said second channel, said clamp body being moveable relatively to said bracket.

3. The apparatus as recited in claim 2 wherein said bracket restrains said clamp body to rotating movement about an axis parallel to said path of travel.

4. The apparatus as recited in claim 1 including a clamp body holder at least partially enclosing said frame, said clamp body holder including at least one slot capable of alignment with said second channel for receipt of the second bar.

5. The apparatus as recited in claim 4 wherein said at least one slot is tapered.

6. The apparatus as recited in claim 4 including a keyed connection between said clamp body holder and at least a portion of said frame.

7. The apparatus as recited in claim 1 wherein said second actuator includes a bracket and a clamp body holder having at least one slot capable of alignment with said second channel, and wherein said clamp body holder and said bracket include meshing teeth for fixing an orientation of said slot relative to said bracket.

8. The apparatus as recited in claim 7 including a wave spring interposed between said clamp body holder and said frame.

9. The apparatus as recited in claim 1 wherein said detent includes a wedge portion adapted to apply a force against the first bar transverse to said path of travel and a block portion adapted to apply a force generally parallel to said path of travel.

10. The apparatus of claim 1 wherein said detent defines said surface oblique to said path of travel and said frame defines a facing surface parallel to said surface oblique to said path of travel.

11. Apparatus for locating a pair of bars in a selected relative orientation, comprising:

a frame defining first and second channels for receiving first and second bars, respectively, and defining first and second extensions;

a clamp bracket engageable with said frame; and a clamp body holder slideably coupled to the frame near the second channel for coordinate rotation with at least a portion of said frame for changing the relative orientation of the extensions of the first and second channels;

said clamp body holder and said clamp bracket include meshing teeth for engagement to fix the selected orientation of the extensions of the first and second channels;

said frame including an elongated clamp body defining a longitudinal axis and said clamp body defining said first channel, said clamp body holder including a sleeve portion at least partially surrounding said clamp body;

a spring interposed between said clamp body and said clamp body holder for biasing said clamp body holder toward disengagement of said meshed teeth; and wherein said clamp body includes a shoulder transverse to said longitudinal axis and said spring is trapped between said shoulder and an opposed abutment of said clamp body holder.

12. The apparatus as recited in claim 11 wherein said clamp body holder includes at least one tapered slot aligned with said second channel.

13. The apparatus as recited in claim 11 wherein said clamp body and said clamp body holder are keyed to inhibit relative rotation.

14. The apparatus as recited in claim 11 wherein said spring is a wave spring.

15. A siderail socket for mounting a support rod of a surgical accessory on a siderail for a medical table comprising:

a rail bracket including a plate and spaced walls, at least one of said spaced walls including a tab spaced from the plate and extending transversely from said one of said spaced walls to define a first channel for receiving the siderail;

a clamp tube rotatably receivable in a first hole in said rail bracket, said clamp tube defining a second channel for receiving the support rod;

a tube holder defining a sleeve for slidably receiving said clamp tube and opposed tapered slots alignable with said second channel for receiving the support rod, said tube holder being movable relative to said clamp tube along a path of travel transverse to an extension of the first channel and said clamp tube being keyed to said tube holder to inhibit rotation of said tube holder relative to said clamp tube;

a rail clamp bracket defining a second hole aligned with said first hole for receiving said clamp tube, said rail clamp bracket including at least one detent extending through a slot in said rail bracket into said first channel;

said detent including a wedge portion adapted to press against the siderail transversely to said path of travel and a block portion adapted to press against the siderail generally in parallel with said path of travel, said wedge portion and said rail bracket defining facing surfaces oblique to said path of travel for actuating said detent in a direction oblique to said path of travel;

said tube holder and said rail clamp bracket including meshing teeth for selecting a relative orientation of the support rod relative to the siderail;

a wave spring interposed between said clamp tube and said tube holder, said clamp tube having a shoulder and said wave spring being trapped between said shoulder and an opposed surface defined by said tube holder; and a clamp handle including a threaded press for extension through a threaded passage in said clamp tube into said second channel, and a crossbar coupled to said threaded press for manually actuating said threaded press into engagement with said support rod.

* * * * *